US008601845B2

(12) United States Patent
Ingvarsson

(10) Patent No.: US 8,601,845 B2
(45) Date of Patent: Dec. 10, 2013

(54) PRODUCTION LINE AND A METHOD OF FORMING PROFILES

(75) Inventor: Lars Ingvarsson, Borlange (SE)

(73) Assignee: Ortic 3D AB, Borlange (SE)

( * ) Notice: Subject to any disclaimer, the term of this patent is extended or adjusted under 35 U.S.C. 154(b) by 1222 days.

(21) Appl. No.: 10/590,183

(22) PCT Filed: Feb. 23, 2005

(86) PCT No.: PCT/SE2005/000246

§ 371 (c)(1),
(2), (4) Date: Aug. 18, 2006

(87) PCT Pub. No.: WO2005/082559

PCT Pub. Date: Sep. 9, 2005

(65) Prior Publication Data

US 2007/0180881 A1 Aug. 9, 2007

(30) Foreign Application Priority Data

Feb. 27, 2004 (SE) ..... 0400485

(51) Int. Cl.
*B21D 5/08* (2006.01)

(52) U.S. Cl.
USPC ..... 72/181; 72/129

(58) Field of Classification Search
USPC ..... 72/129, 131, 167, 177, 181, 166, 180
See application file for complete search history.

(56) References Cited

U.S. PATENT DOCUMENTS

| | | | | |
|---|---|---|---|---|
| 3,051,214 | A * | 8/1962 | Rutten et al. | 72/12.1 |
| 4,558,577 | A * | 12/1985 | Trishevsky et al. | 72/12.7 |
| 5,722,278 | A * | 3/1998 | Horino et al. | 72/8.3 |
| 7,107,807 | B2 * | 9/2006 | Ingvarsson et al. | 72/181 |
| 7,111,481 | B2 * | 9/2006 | Green et al. | 72/11.2 |
| 2004/0244453 | A1 * | 12/2004 | Schule | 72/167 |

FOREIGN PATENT DOCUMENTS

| | | |
|---|---|---|
| AU | 199859441 | 5/2001 |
| EP | 1245302 | 10/2002 |
| WO | 0243886 | 6/2002 |
| WO | 03041886 | 5/2003 |

* cited by examiner

*Primary Examiner* — Debra Sullivan
(74) *Attorney, Agent, or Firm* — Mark P. Stone

(57) ABSTRACT

Profiles (50) are formed in a production line with a cross-section that varies along their length from a plane metal strip (10) that is unwound from a coil (9), whereby edge cutters (14) and a number of roll-forming units (17-24) are used where not only the edge cutters but also the roll-forming units can be displaced individually sideways relative to the strip. The edge cutters (14) and the roll-forming units (17-24) are individually controlled such that they follow the lines of extent of the side edges (51, 52) that are cut and the lines of the corners (53-56) that are subsequently formed, and the forming of one corner with a number of roll-forming units is started only after the forming of a corner that lies more closely to the edge of the strip has been completed. The formed profile is bent in a bending station integrated into the line, which bending station comprises rollers (35-40) that can be controlled to roll sections of the profile (50) to become thinner such that the profile is bent or twisted as it is formed.

14 Claims, 8 Drawing Sheets

Fig 7
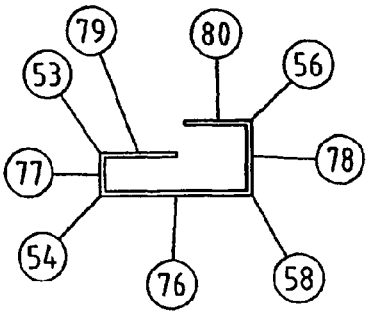
Fig 6
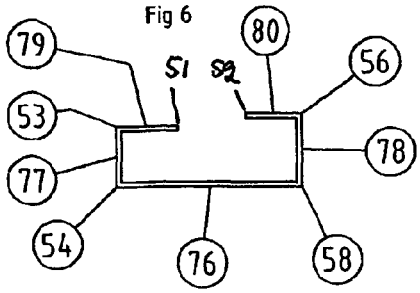
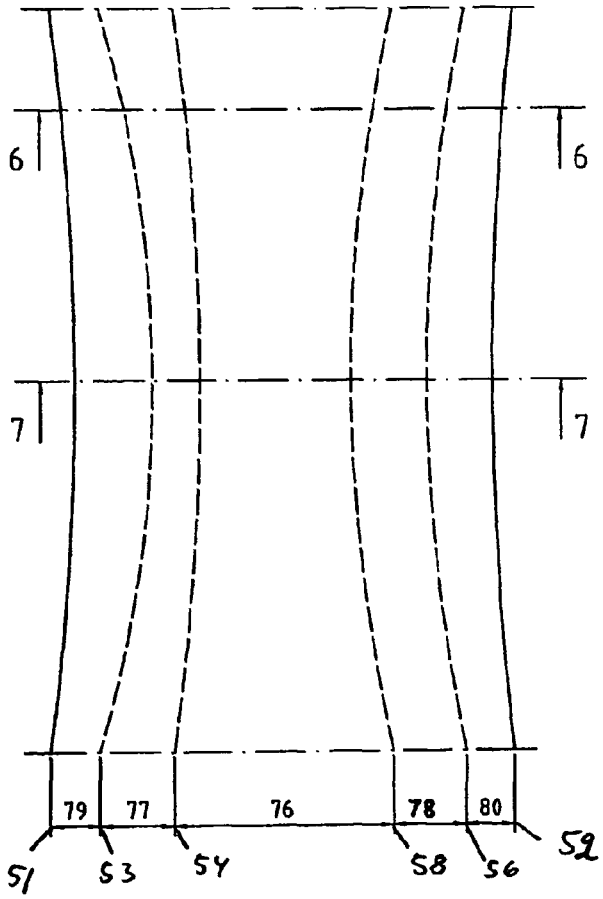
Fig 8

Fig 13
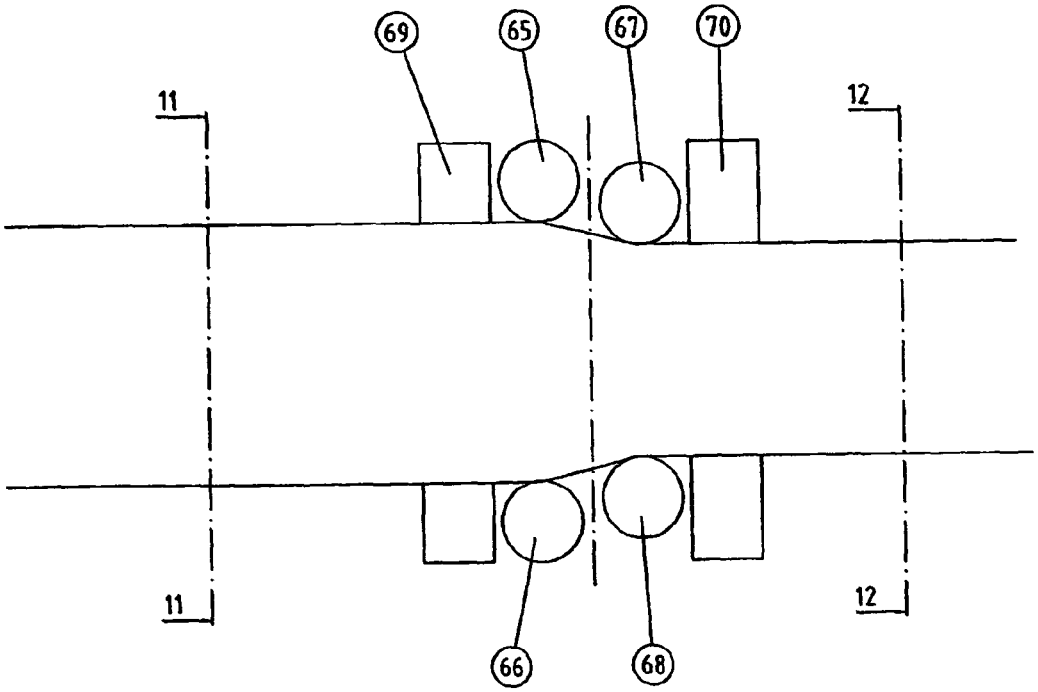
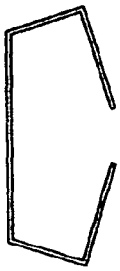
Fig 11
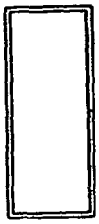
Fig 12

PRODUCTION LINE AND A METHOD OF FORMING PROFILES

TECHNICAL AREA

The present invention relates to a method to form in a line profiles that have a variable cross-section along their lengths from a plane strip of metal that is uncoiled from a coil, whereby edge cutters and a number of roll-forming units are used where not only the edge cutters but also the roll-forming units can be individually displaced in a transverse direction relative to the strip. The invention also relates to a continuous production line.

c

THE PRIOR ART

WO 02/43886 A1 describes a roll-forming machine that is used in this way to fold up and form the edges of a roofing sheet of the type known as "standing seam". The width of the roofing sheet can be varied along the length of the sheet and the vertical edges have the same form along the complete length.

AIM OF THE INVENTION

It is one aim of the invention to provide economic manufacture of sheet metal profiles with profiles that can be varied along the length of the profile and in particular of profiles that may, in addition, be curved.

This is primarily achieved according to the method of the invention by controlling the edge cutters and the roll-forming units individually to follow the lines of extent of the side edges that are cut and the corners that are subsequently formed, and to begin the forming of a corner with a number of roll-forming units only after the forming of a corner that lies closer to the edge of the strip has been completed. Should a bent profile be desired, parts of the profile plate are rolled to become thinner, as the roll-formed profile is fed forwards in the line, such that the profile becomes curved.

A production line according to the invention comprises a bending station after the roll-forming line and this bending station comprises rollers that can be controlled to roll parts of the profile more thinly such that the profile becomes curved or twisted as it is formed.

The invention is defined by the attached patent claims.

BRIEF DESCRIPTION OF THE DRAWINGS, WHICH SHOW EQUIPMENT ACCORDING TO THE INVENTION BY WHICH THE METHOD ACCORDING TO THE INVENTION CAN BE EMBODIED

Figure 2:
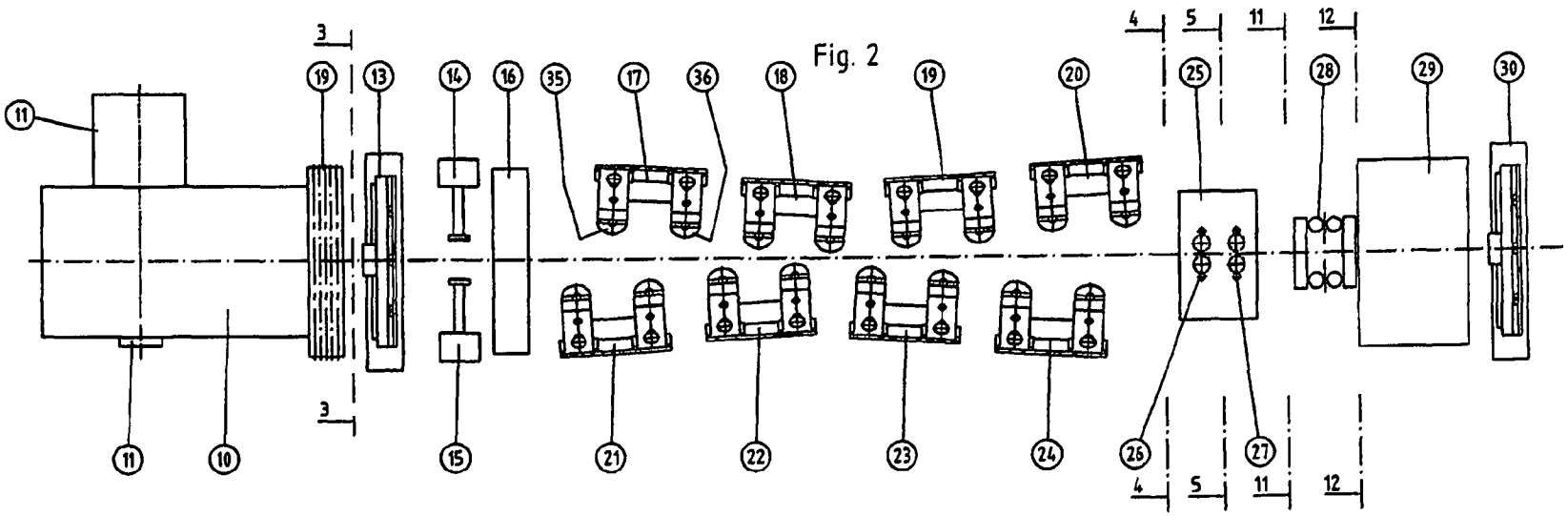
FIG. 2 illustrates a view from above of the line in FIG. 1.
Figure 9:
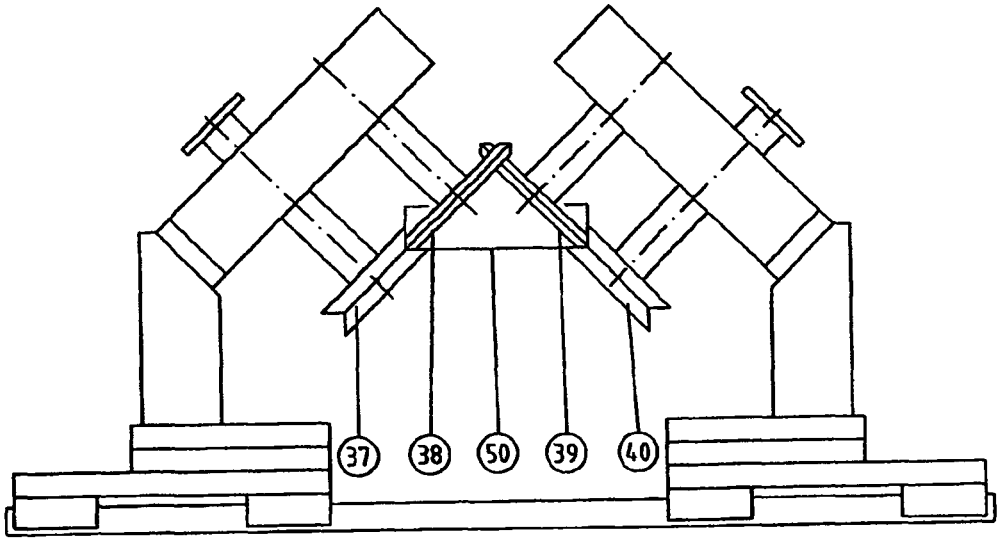
Figure 10:
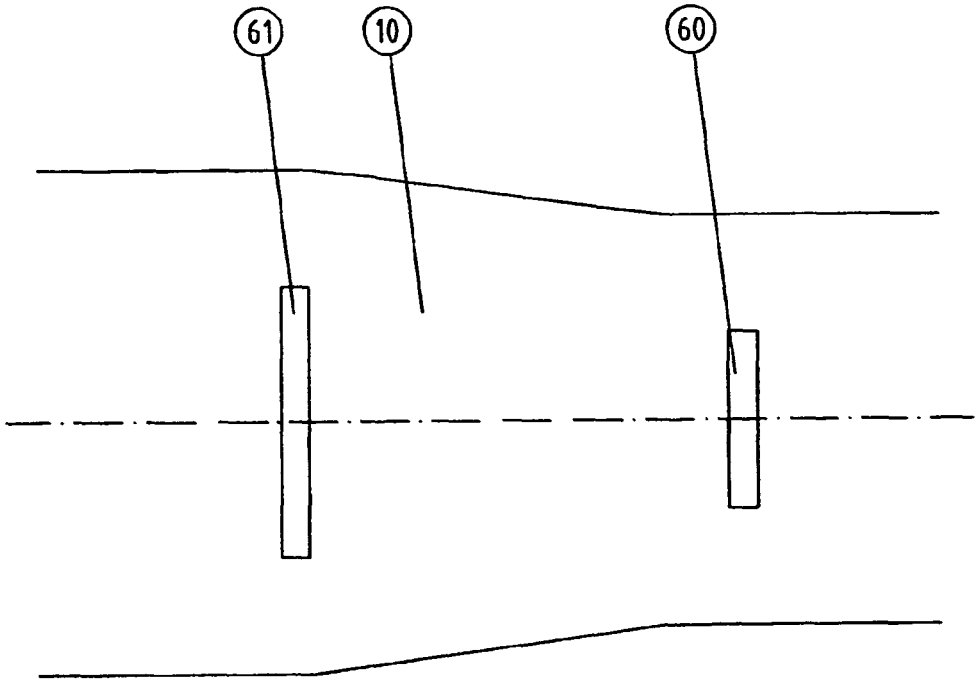

FIGS. 6 and 7 show cross-sections of a strip formed in the equipment that is shown in the preceding figures, where the cross-sections are taken along the lines 6-6 and 7-7 in FIG. 8;

FIG. 8 is an extension of the formed strip shown in FIGS. 6 and 7;

FIG. 9 shows the final roll-forming step of the production line in the forming of a C-profile;

FIG. 10 shows a part of an edge-cut and punched strip before profiling;

FIGS. 11 and 12 show sections taken before and after a tube-forming unit as is specified by the lines 11-11 and 12-12 in FIG. 13 and in FIG. 2;

FIG. 13 shows enlarged and schematically a tube-forming unit seen from above.

DESCRIPTION OF ILLUSTRATED AND PREFERRED EMBODIMENTS

Figure 1:
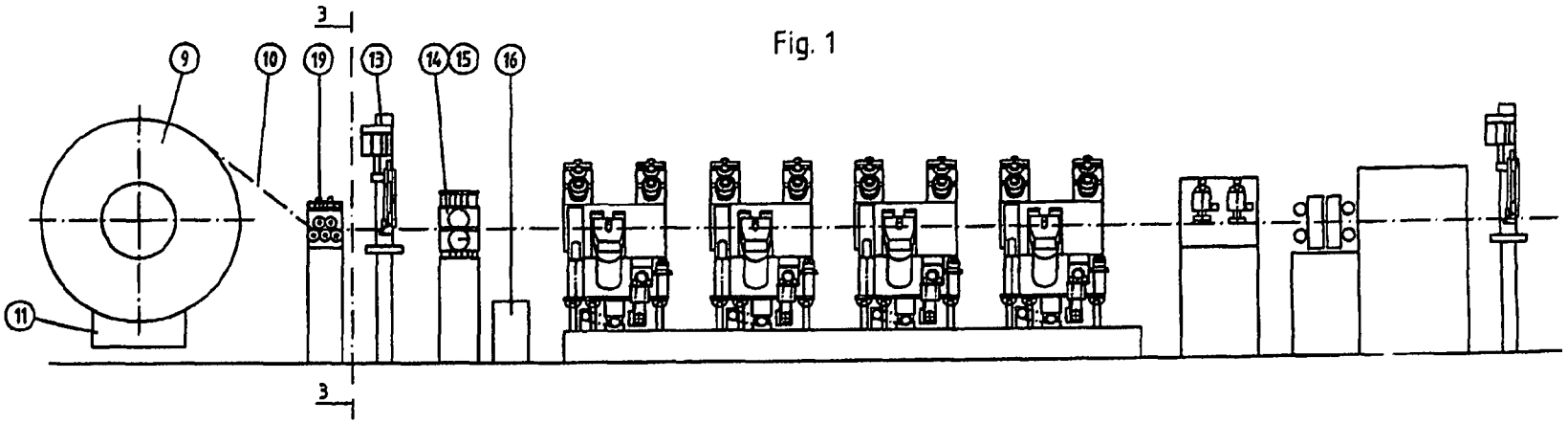
FIG. 1 illustrates a production line schematically in a side view.

FIGS. 1 and 2 show schematically a production line that contains an unwinder 11 for unwinding a metal strip 10 from a coil 9, a straightening device 12 for aligning the plane of the metal strip 10, an initial stamp 13, an edge cutter station 14, 15 on each side of the strip 10, a waste mill 16 for collecting the edges of the strip that have been removed, four roll-forming units 17-20 and 21-24 on each side of the strip 10 for folding the strip into a profile, a bending station 25 that contains two bending units 26, 27 for bending the formed profile, a tube-forming unit 28 for closing the formed profile, a welding unit 29 for welding the seam of the closed profile, and a terminal cutter 30 for the final cutting of the completed profile.

Figure 3:
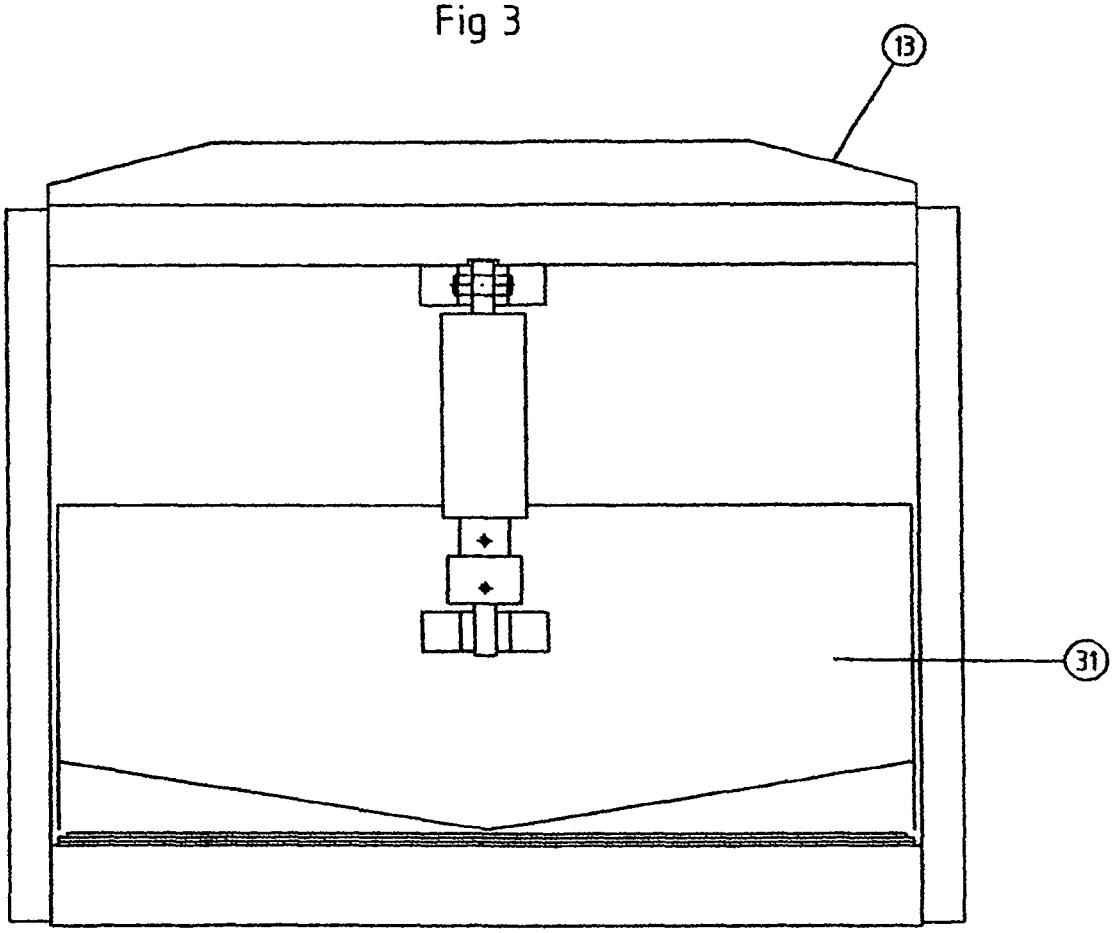
FIG. 3 is a sectional view along the line 3-3 in FIG. 2, showing enlarged and schematically a punch.

FIG. 3 shows enlarged the initial stamp 13, which has an angle cutter 31 such that it begins the stamping in the centre of the strip and such that the stroke length determines the length of the slit.

The edge cutter stations 14, 15 can be individually displaced in a sideways direction, that is, transverse to the direction of the strip. The roll-forming units 17-24 are all identically constructed and they can all be individually displaced. They have a carrier that supports, as is shown on the roll-forming unit 17, two pairs of rollers 35, 36 in tandem, and they can be displaced in a sideways direction and rotated around a vertical axis. FIG. 9 shows the final roll-forming step on each side of the strip in order to give the final C-profile 50 with two pairs of forming rollers 37, 38; 39, 40.

FIGS. 6 and 7 show two cross-sections of a completed C-profile 50 that has an asymmetric cross-section and a varying cross-section along its length. The edges of the profile have been given the reference numbers 51, 52, and its corners have been given 53-56. In the line of extent of one part of the length of the profile that is shown as FIG. 8, the corners are shown with dashed lines and the cross-sections given in FIGS. 6 and 7 have been indicated by the lines 6-6 and 7-7 in FIG. 8. The C-profile can be defined as having a central flange 76 between the corners 54, 55; two upright sides 77, 78 between the corners 53, 54 and 55, 56; and two inwardly bent side-flanges 79, 80 between the corners, 53, 56 and the edges 51, 52. The dashed lines illustrated in FIG. 8 are predetermined curved lines which the rollers pairs and edge cutters are controlled to follow to form the corners.

The manufacture of a C-profile with a varying cross-section will now be described.

The strip alignment device 12 aligns the strip that is uncoiled from the coil 9 and feeds the strip forwards through the line. Feeding is stopped when the metal that is to be the end of a profile length reaches the initial stamp 13 and a transverse slit is punched out. If the trailing of one length of sheet and the leading end of the next length of sheet do not have the same extent, with the leading end being, for example, broader than the trailing end of the previous sheet, as is shown in FIG. 10, a slit 60 is first made for the trailing end and a slit 61 is subsequently made for the leading end once the strip has been fed forwards through a certain distance. The length that lies between will become a waste piece when the lengths are finally separated as will be described later. FIG. 10 shows the strip as it appears after it has been punched and after the edges have been cut. The cutting of the edges may be carried out after the punching as is shown, or it may be carried out before the punching. The lengths of the slits are adapted such that the corners 53, 56 of the final profile are removed by stamping and only the plane parts between the corners 53, 56 and the ends 51, 52 remain for the final profile. The slits are made sufficiently wide such that it will be possible later to cut away the final profile using tools that enter through the slits from underneath.

The first two roll-forming units 17, 18 and 21, 22 on each side of the strip are controlled such that their forming rollers follow the outermost corners 53, 56, that is, they follow the lines 53, 56 across the extent (FIG. 8). There are two steps with pairs of forming rollers in tandem in each roll-forming unit, and thus each roller pair will not follow exactly the line of extent. However, the lines of extent have gradual bends, and this means that the error will be so small that it does not have any practical significance. It is also often possible to have three roll-forming steps at each roll-forming unit 17-24. It is also possible, if required, to have several roll-forming units in the line such that it is possible to use several roll-forming steps for each corner and to be able to roll-form more corners than the four corners that are shown. The term "corner" is used to denote not only sharp corners such as those shown but also corners in the form of bends. Nor is it necessary that the roll-forming is carried out in a symmetrical manner on the two sides of the strip as shown. When a point on the strip passes the roil-forming units 18 and 22, the corners 53 and 56 are fully formed and the roll-forming of the corners 54, 55 then commences. When the strip passes the final roll-forming step, the strip has achieved its final form and in this case, when the profile is an open C-profile, it passes the bending station 25, the tub-forming unit 28 and the welding unit 29, without being processed or formed. When the first slit 60 reaches the terminal cutter 30 feed of the strip is halted and the cutter passes up through the slit and completely cuts off the profile. The strip is then fed forwards and stopped when the slit 61 reaches the terminal cutter 30. The profile is then cut at this location and the intermediate section of profile becomes waste. It is also possible, naturally, to form other profiles than C-profiles, such as, for example, hat-profiles. If more roll-forming units than those shown are used, it is possible to form profiles with more corners than those shown. It is possible to determine for each profile how many roll-forming units are to be used for each corner, since the roll-forming units can be individually controlled.

When a closed C-profile is to be formed, it is not possible to roll-form it to its final form since it is necessary to induce form-rollers into the profile in the manner that is shown in FIG. 9. The roll-forming therefore ends with a profile such as that shown in FIG. 11 and in the roll-forming unit 28, which in one or several steps presses the profile together with vertical rollers 65-68 and provides support at the bottom with horizontal rollers 69, 70 as is shown both in FIGS. 1 and 2 and, enlarged, in FIG. 13. The profile thus obtains the closed form that is shown in FIG. 12 and it is then directly seam-welded in the welding unit 29, which is located in the direct vicinity such that the profile cannot spring open.

Figure 4:
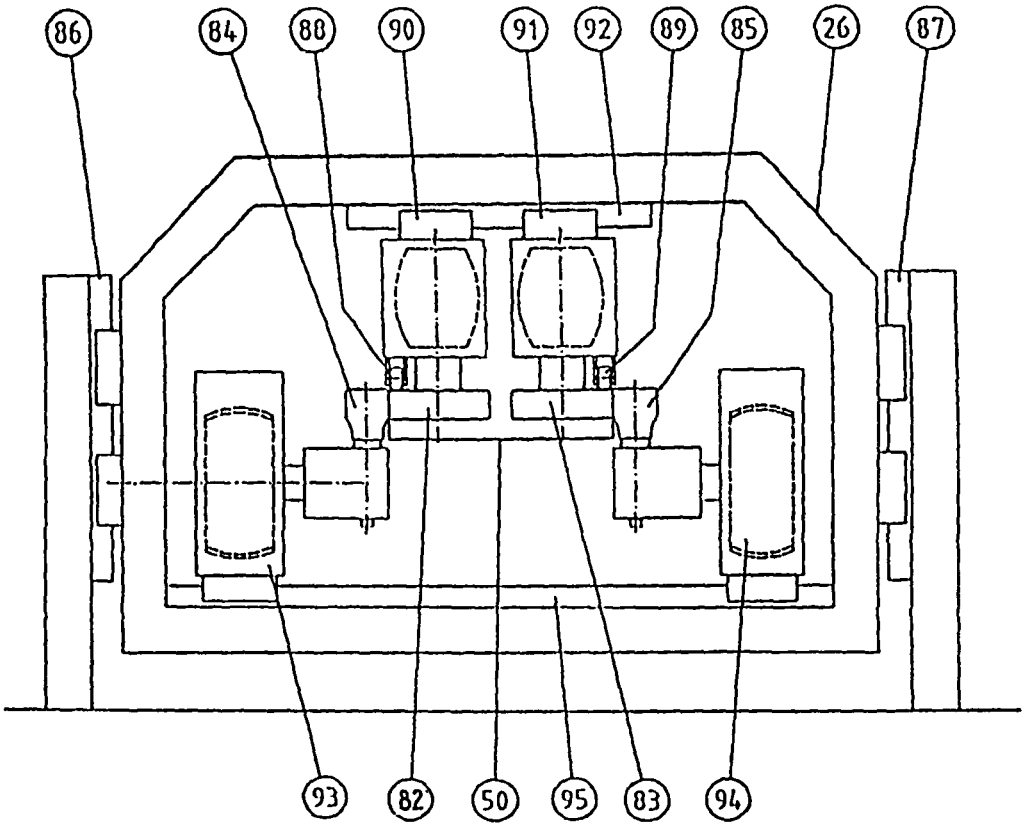
FIG. 4 is a sectional view along the line 4-4 in FIG. 2, showing enlarged and schematically a first bending unit for bending of the profile formed.
Figure 5:
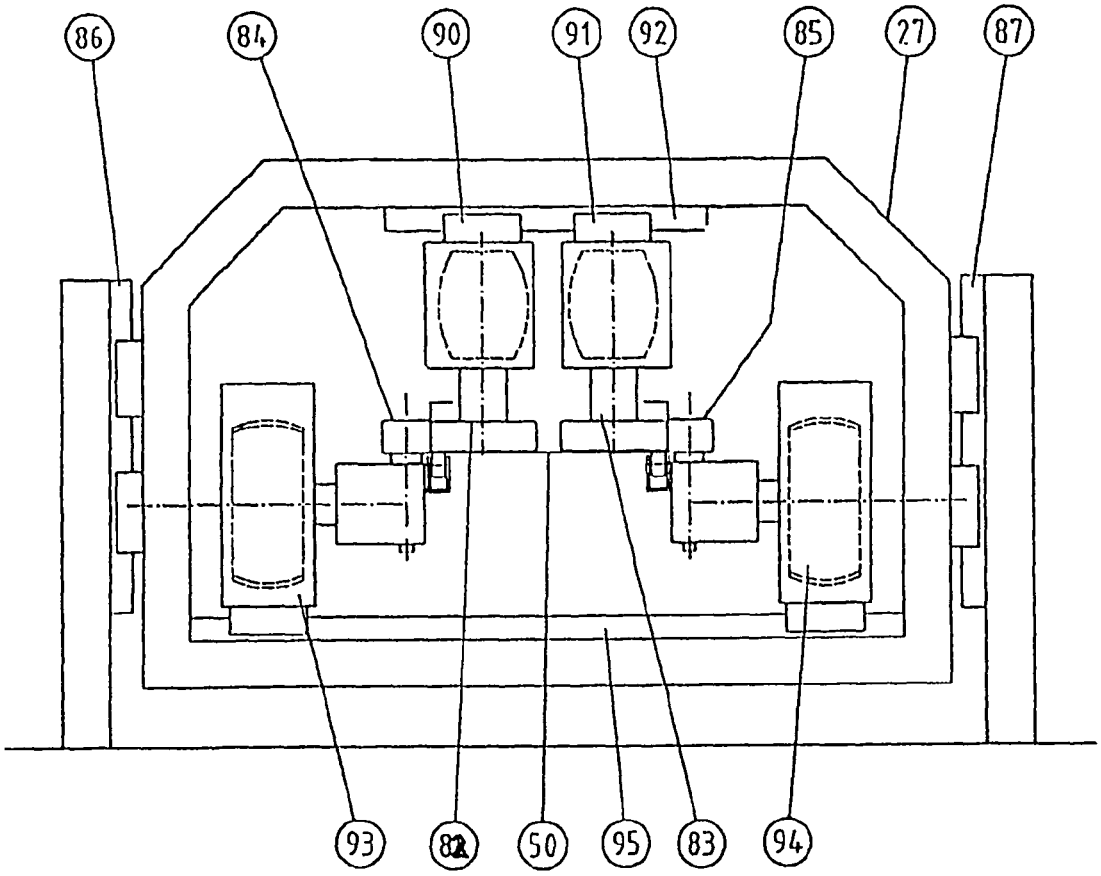
FIG. 5 is a sectional view along the line 5-5 in FIG. 2, showing enlarged and schematically a second bending unit for bending of the profile formed.

FIGS. 4 and 5 show the two bending units 26, 27 that are used when it is desired to bend or twist the profile. The profile 50 is given the same reference numbers as in FIG. 6, although not all numbers are present in FIG. 4.

The unit 26 shown as FIG. 4 will be described in more detail. It has counter rollers 82, 83 inside the profile 50 and these counter rollers can be adjusted to make contact with the upper part of the vertical sides of the profile. Rollers 84, 85 make contact with the outer surface of the vertical sides. The complete bending unit 26 can be freely displaced vertically along rails 86, 87 in the support and it follows the upper part of the vertical sides through sprung units 88, 89 lightly pressing against the upper inwardly bent flanges of the profile and holding the flanges between themselves and the counter rollers 82, 83. The counter rollers are supported on units 90, 91 that can be transversely slid along a rail and the rollers 84, 85 are supported by units 93, 94 that can be slid along a rail 95. The counter rollers and the rollers 82-85 can be adapted to the profile in that it is possible to adjust their angles or the gap between the rollers to a limited extent within the relevant unit 90, 91, 93, 94 along partial surfaces of circles as has been suggested in the figure by dashed lines. The various power units for carrying out the adjustment and supplying power are not shown in the figure. These may, for example, by hydraulic units.

The profile will be bent downwards when the rollers are pressed with a large force and with some obliqueness against the vertical sides of the profile in order gradually to thin the vertical sides upwards. The rollers are supplemented with support and guide rollers located after the rollers, in order to give the profile an exact form in all three dimensions. These support and guide rollers are not shown in the figures.

The unit 27 shown in FIG. 5 has a similar structure to the unit 26 that has been described above and is shown in FIG. 4. The unit shown in FIG. 5 will, therefore, not be described in detail. Equivalent items have the same reference numbers as they have in FIG. 4. The unit 27 is guided vertically by the central flange of the profile and the rollers 84, 85 are arranged to roll the vertical sides of the profile gradually thinner against this central flange, such that the profile bends upwards.

In order to bend the profile in a sideways direction, the rollers of both units are used on the same side, such that the complete vertical side of one side of the profile is thinned and bends the profile in the opposite direction. In order to twist the profile, the roller of the unit 26 is used on one vertical side of the profile, while the roller of the unit 27 is used on the second vertical side of the profile.

Thus it is possible to bend the profile in a freely chosen direction by controlling the rolling forces of the rollers 84, 85, and it is also possible to twist the profile in the desired direction. It is also possible to control all four rollers at the same time, such that the profile is both bent and twisted at the same time.

It should be possible to displace the units that are located after the bending unit, i.e. the tube-forming unit 28, the welding unit 29 and the terminal cutter 30, both in a vertical and in a horizontal direction, and it should be possible to turn these units, if it is desired to use them for bent and twisted profiles.

Not all of the means available on the machine for twisting, displacing, etc., are shown on the drawings. All of these means are controlled by a programmable computer system such that they work simultaneously in order to give the desired result.

The invention claimed is:

1. A method for forming, in a production line, profiles (50) with a cross-section that varies along the length thereof, said profiles being formed from a plane metal strip (10) that is unwound from a coil (9), said method employing edge cutters (14) and a plurality of roll-forming units (17-24), the edge cutters and the roll-forming units being individually displaceable sideways relative to the strip, the steps of said method comprising:

controlling the edge cutters along a first pair of opposed curved lines (51, 52) to sever opposed edges of said strip as said strip moves along the production line to provide the strip with curved opposed edges;

thereafter controlling the roll-forming units along a second pair of opposed curved lines (53, 56) for forming a first pair of corners (53, 56) defining opposed flanges (79, 80) to each side of the center of said metal strip (10) as said strip moves through a first roll-forming section of said production line, and thereafter controlling the roll-forming units along a third pair of opposed curved lines (54, 58) for forming a second pair of corners (54, 58) defining opposed sides (77,78) to each side of the center of said metal strip between said first corners, after said first corners have been formed, as said strip moves through a second roll-forming section of the production line, wherein the curvatures of the first, second, and third pairs of opposed curved lines vary the cross section of the profile formed from the strip along the length thereof.

2. The method according to claim 1, further including the steps of cutting a transverse slit (61, 62) in the strip (10) before forming the first and second corners, without fully severing the strip, and severing the strip with a terminal cutter (30) after the first and second corners are formed to remove a trailing end from the length of said profile formed from the strip.

3. The method according to claim 2, in which the lengths of the profile formed have different widths of extent at opposed ends of said profile, the steps of said method including adjusting the width of the strip between one slit (60) that defines the trailing end of the length of one said profile, cutting a further slit (61) to define a leading end of the length of a subsequent said profile, and thereafter cutting the strip at both said slits with the terminal cutter (30).

4. The method according to claim 1, further including the steps of thinning a portion of the profile by a pair of rollers (83, 85; 84, 82) for bending the profile as said profile is fed forwards in the production line.

5. The method according to claim 4, further including the steps of controlling the bending of the profile by varying a gap between said pair of rollers (83, 85; 84, 82) through which said profile passes as the profile (50) is fed forwards in the production line.

6. The method according to claim 5, further including the step of controlling the positions of the pair of rollers (83, 85; 84, 82) by the profile.

7. The method according to claim 5, further including the steps of forming the profile (50) with a central flange (76) and flanking pieces (77, 79) as the strip (10) is fed forwards in the production line, and thinning one end of each said flanking piece by rolling.

8. The method according to claim 7, further including the step of controlling the positions of the pair of rollers (83, 85; 84, 82) by the profile.

9. The method according to claim 5, further including the steps of forming the profile (50) with a central flange (76) and flanking pieces (77, 79) as the strip is fed forwards in the production line, and thinning a complete one of said flanking pieces by rolling.

10. The method according to claim 9, further including the step of controlling the positions of the pair of rollers (83, 85; 84, 82) by the profile.

11. The method according to claim 4, further including the steps of forming the profile (50) with a central flange (76) and flanking pieces (77, 79) as the strip (10) is fed forwards in the production line, and thinning one end of each said flanking piece by rolling.

12. The method according to claim 11, further including the step of controlling the positions of the pair of rollers (83, 85; 84, 82) by the profile.

13. The method according to claim 4, further including the steps of forming the profile (50) with a central flange (76) and flanking pieces (77, 79) as the strip is fed forwards in the production line, and thinning a complete one of said flanking pieces by rolling.

14. The method according to claim 13, further including the step of controlling the positions of the pair of rollers (83, 85; 84, 82) by the profile.

* * * * *

UNITED STATES PATENT AND TRADEMARK OFFICE

CERTIFICATE OF CORRECTION

PATENT NO. : 8,601,845 B2
APPLICATION NO. : 10/590183
DATED : December 10, 2013
INVENTOR(S) : Lars Ingvarsson It is certified that error appears in the above-identified patent and that said Letters Patent is hereby corrected as shown below:

In the Specification

Column 3, Line 35: Delete "55" and substitute --58--.

Signed and Sealed this
Eighteenth Day of February, 2014

Michelle K. Lee

Michelle K. Lee
*Deputy Director of the United States Patent and Trademark Office*